US007099754B2

(12) United States Patent
Sugita et al.

(10) Patent No.: US 7,099,754 B2
(45) Date of Patent: Aug. 29, 2006

(54) SIGNAL SAFETY METHOD, SIGNAL SAFETY APPARATUS AND SIGNAL SAFETY SYSTEM

(75) Inventors: Yoichi Sugita, Hitachi (JP); Dai Watanabe, Hitachi (JP); Takatoshi Miyazaki, Fuji (JP); Kiyoshi Chiba, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 329 days.

(21) Appl. No.: 10/737,981

(22) Filed: Dec. 18, 2003

(65) Prior Publication Data

US 2004/0193336 A1 Sep. 30, 2004

(30) Foreign Application Priority Data

Dec. 26, 2002 (JP) ..... 2002-375807

(51) Int. Cl.
*B61L 1/00* (2006.01)

(52) U.S. Cl. ..... 701/19; 701/20; 246/14; 246/20; 246/22; 246/27; 246/29; 246/182 R

(58) Field of Classification Search ..... None
See application file for complete search history.

(56) References Cited

U.S. PATENT DOCUMENTS 4,533,871 A * 8/1985 Boetzkes ..... 340/10.2
5,398,894 A * 3/1995 Pascoe ..... 246/28 R
5,452,870 A * 9/1995 Heggestad ..... 246/182 R
5,803,411 A * 9/1998 Ackerman et al. ..... 246/169 R
5,950,966 A * 9/1999 Hungate et al. ..... 246/62
6,135,396 A * 10/2000 Whitfield et al. ..... 246/182 R
6,666,411 B1 * 12/2003 Hart et al. ..... 246/62

FOREIGN PATENT DOCUMENTS

JP 3-292255 12/1991

OTHER PUBLICATIONS

M. Kanayama et al., "Development of the block control system for IMTS (Intelligent Multi-mode Transit System)", Transaction of the 2001 Joint symposium of Railway Technologies, pp. 255-258, published in 2001.

* cited by examiner

*Primary Examiner*—Thomas G. Black
*Assistant Examiner*—Eric M. Gibson
(74) *Attorney, Agent, or Firm*—Crowell & Moring LLP

(57) ABSTRACT

In order to propose a method of promptly judging movement of a train between block sections with a minimum number of transponders, an on-ground train control part for controlling operation of a train; an on-ground communication means capable of performing communication of information by coming within a specified range; and a sending-and-receiving part capable of sending the information received by the on-ground communication device to the on-ground train control part and receiving the information sent from the on-ground train control part, are provided, thereby, a position of presence of train is grasped by receiving a speed of the train using the on-ground communication means when the on-train communication means attached to the train comes near.

9 Claims, 4 Drawing Sheets

TABLE OF PRESENCE/ ABSENCE OF TRAIN ON BLOCK SECTION 400

| BLOCK NO. | 1 | 2 | 3 | 4 | ··· | N |
|---|---|---|---|---|---|---|
| PRESENCE(1)/ ABSENCE(0) | 1 | 0 | 0 | 1 | ··· | 0 |

SIGNAL SAFETY METHOD, SIGNAL SAFETY APPARATUS AND SIGNAL SAFETY SYSTEM

BACKGROUND OF THE INVENTION

The present invention relates to signal safety of a transport system for performing transportation by a train moving on a rail, that is, railway and city traffic such as monorail, light rail transit (LRT), automated guided train (AGT) etc.

In a railway system using narrow-area wireless communication means, as a method of detecting a railway train, such as transponder, valise etc which are used as small-sized communication units installed on the ground and on a train (hereinafter, description will be made by taking the transponder as an example of the narrow-area wireless communication means), presence/absence of the train is judged by performing communications of the train ID between the ground and the train using the transponders discretely arranged along the rail. That is, the presence/absence of the train is judged through a check-in-check-out method in which receiving of the train ID by a transponder arranged in another region is regarded the train as not being present in a region having a transponder which the same train ID has previously been received from. This is that a confirmation of presence at one place leads an evidence of absence at the other places.

The details will be described below. Transponders for performing communication between a train and the ground are arranged on the train and on the ground. A block section is a section in which only one train is allowed to be present, but a set of transponder is arranged there in a conventional system(refer to patent reference 1 as shown later). It is provided that a train B bound for a station a is waiting for a train A to depart from the station a now. In the check-in-check-out method, presence/absence of the train in a block section is judged through the following processes. The train B departs from the station a, and enters into a neighboring block section, but the block section of the station a is not judged to be absent. It is not judged that there is no train in the block section of the station a, until a transponder provided in the station b detects that the train A reaches a neighboring block section. That is, the train detecting method is that the train A reaches the station b, and then, by receiving a signal of absence of train in the block section of the station a, the train B starts to proceed to the station a.

Because in this method, only one set of transponder is arranged in one block section (the train has one in the front and another in the rear of the train), absence of the train in the block section of a station can not be judged until the train reaches the neighboring station. In order to solve this problem, a configuration of transponders disclosed in non-patent reference 1 as shown later is employed. In this configuration, by arranging transponders individually at the entrance and at the exit of a block section, entering of a train departing from a station into the neighboring block section is promptly detected by the transponder provided at the entrance of the neighboring block section. More specifically, departure of the train A from the station a is certainly detected by the fact that the train A departing from the station a passes through the transponder provided in the exit side of the station, the following train B can promptly proceed to the station a by setting the block section of the station a to absent.

[Patent Reference 1]

Japanese Patent Application Laid-Open No. 3-292255 (all pages)

[Non-patent Reference 1]

"Development of a block control system for IMTS", Transaction of The 2001 Joint symposium of Railway Technologies, pp. 255–258, published in 2001.

SUMMARY OF THE INVENTION

The above conventional technologies have the following problems. In the case where trains are operated making an interval between the trains as short as possible by promptly detecting movement of the trains between block sections, it is necessary that transponders are arranged individually at the entrance and the exit of the block section. That is, the required cost becomes twice as high as that in the case where one set of transponder is arranged in one block section. On the other hand, in the case where movement of the train between the block sections is intended to be promptly detected using only one set of transponder, a contrivable method is that communication between a transponder provided in the rear of the train and a transponder provided at the exit side of the station is monitored, and ending of the communication is regarded as the fact that the train leaves the station and moves into the neighboring block section. However, the ending of the communication is not clear. Therefore, if occurrence of a failure to end the communication is regarded as leaving of the train from the block section, a judgment of absence will be made though the train is kept stopping.

Further, even in a case where the ending of the communication can be clearly judged, since there is a distance between the transponder provided in the station exit side and the boundary of block section, presence of the train within the section is unpredictable. That is, when the train stops after ending of the communication, a judgment of absence is made though the train is present. This is a serious problem from the viewpoint of safety.

An object of the present invention is to propose a method of promptly judging movement of a train between block sections with a minimum number of transponders.

In a signal safety apparatus and a signal safety method for grasping a position of presence of train on the ground and on a train, the signal safety apparatus of the present invention comprises an on-ground train control part for controlling operation of a train; an on-ground communication device capable of performing communication of information by coming within a specified range; and a sending-and-receiving part capable of sending the information received by said on-ground communication device to the on-ground train control part and receiving the information sent from the on-ground train control part, wherein when an on-train communication device attached to a train comes within the specified range, the on-ground communication device receives a speed of the train from the on-train device.

Further, the signal safety apparatus of the present invention is constructed in such that the on-ground communication device is placed on a boundary of a block section in which only one train is allowed to be present, and that in communication between the on-ground communication device and the on-train communication device, the on-ground communication device receives a speed of the train and pre-registered identification information of the train from the on-train communication device.

Further, the signal safety apparatus of the present invention is constructed in such that when the speed of the train received through the sending-and-receiving part is larger than a predetermined value, the on-ground train control part outputs a permission signal for permitting the train to move to a next neighboring block section, and judges that the block section in which the communication has been performed is in a state of absence of train.

Further, the signal safety apparatus of the present invention is constructed in such that when the speed of the train received through the sending-and-receiving part is larger than a predetermined value, and a preset time has elapsed after the on-ground communication device receives the speed of the train, the on-ground train control part outputs a permission signal for permitting the train to move to a next neighboring block section, and judges that the block section in which the communication has been performed is in a state of absence of train.

Further, the signal safety apparatus of the present invention is constructed in such that the preset time means a time period from the time when the on-ground communication device receives the speed of the train until the train has passed through a boundary of the next neighboring block section.

Further, the signal safety apparatus of the present invention is constructed in such that the on-ground communication device sends the permission signal for permitting the train to move received by the sending-and-receiving part from the on-ground control part.

Further, the signal safety apparatus of the present invention is constructed in such that the on-ground communication device sends upper limit speed information or information for producing the upper limit speed information from the on-ground control part to the on-train communication device through the sending-and-receiving part.

Further, the signal safety apparatus of the present invention is constructed in such that when identification information of a train received by the on-ground communication device through a communication between the on-train communication device and the on-ground communication device in a block section agrees with identification information of a train received by the on-ground communication device through a communication between the on-train communication device and the on-ground communication device in the next block section neighboring to the block section, the on-ground train control part judges that the block section is in a state of absence of train.

Further, in a signal safety system for grasping a position of presence of train on the ground and on a train, the signal safety system of the present invention comprises an on-ground train control part for controlling operation of a train; an on-ground communication device capable of performing communication of information by coming within a specified range, the on-ground communication device being placed on a boundary of a block section in which only one train is allowed to be present; a sending-and-receiving part capable of performing communication with the on-ground train control part through a network, the sending-and-receiving part being capable of sending information received by the on-ground communication device to the on-ground train control part and receiving information sent from the on-ground train control part; and an on-train communication device capable of performing communication with said on-ground communication device, said on-train communication device being attached to said train, wherein when the on-train communication device comes near the on-ground communication device, the on-ground communication device receives a speed of the train and pre-registered identification information of the train from the on-train communication device and sends the speed of the train and the identification information of the train to the sending-and-receiving part, the on-ground train control part outputting a permission signal for permitting the train to move to a next neighboring block section based on the speed of the train and the identification information of the train received from the sending-and-receiving part through the network, the on-ground communication device sending the permission signal received from the on-ground train control part to the on-train communication device.

The signal safety system of the present invention further comprises a speed detecting part for detecting a speed by sensing rotation speed of a wheel shaft, said speed detecting part being arranged in said train.

DETAILED DESCRIPTION OF THE PREFERRED EMBODIMENTS

Figure 1:
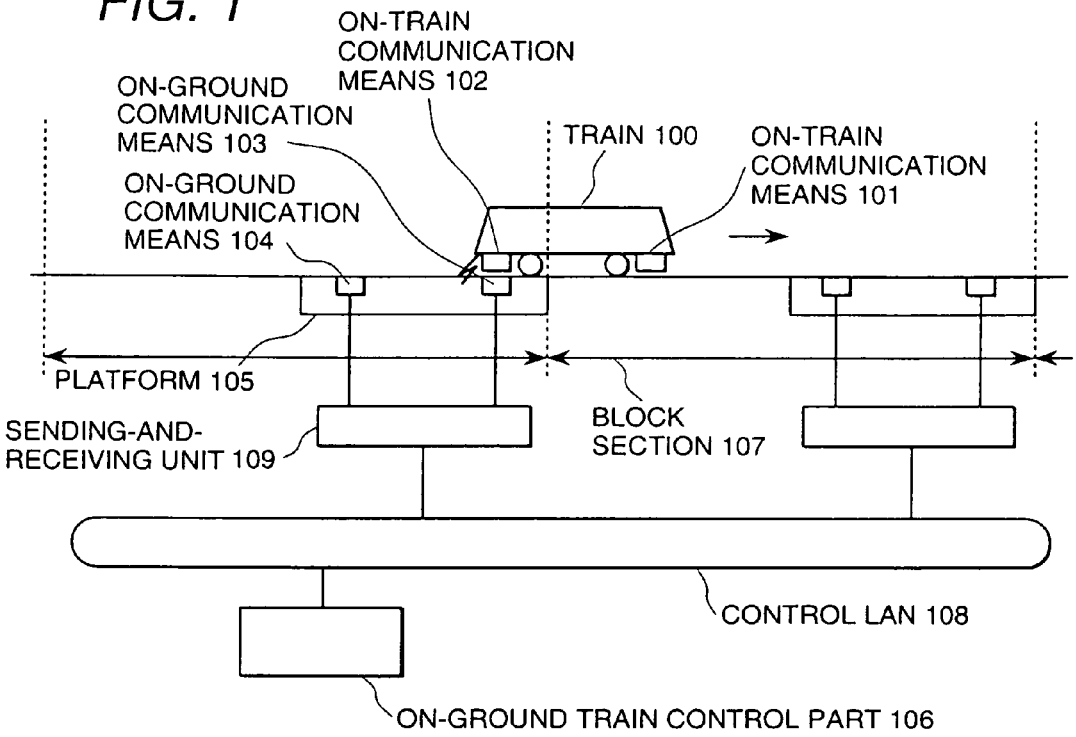
FIG. 1 is a view showing an embodiment of a signal safety system in accordance with the present invention.

An embodiment of a signal safety system in accordance with the present invention will be described below, referring to the accompanied drawings. FIG. 1 shows the construction of the objective signal safety system.

The signal safety system comprises a train 100; on-train communication devices of on-train communication means 101 and 102 for sending information in the train to the ground side; on-ground communication devices of on-ground communication means 103 and 104 capable of performing communication with the on-train communication devices; a platform 105; an on-ground train control part 106 for managing and controlling operation of the railway train; a control LAN 108 of a network; and a sending-and-receiving part 109 for sending and receiving the information through the on-ground control part and the network. The on-train communication means 101 and the on-train communication means 102 are arranged in the top end and in the rear end of the train 100, respectively. The on-ground communication means 103 and the on-ground communication means 104 are provided in the platform, and are arranged at positions corresponding to the on-train communication means 101 and 102 so that communication can be performed between the on-train communication means 101 and the on-ground communication means 103 and between the on-train communication means 102 and the on-ground communication means 104, respectively, when the train 100 is stopping by the platform. The on-ground control part 106 grasps and controls the position of the train by sending and receiving a pre-registered train ID (an identification number of the train) between the ground and the train using the on-train communication means 101 and 102 and the on-ground communication means 103 and 104 through the sending-and-deceiving unit 109, and performs train control for safety such as prevention of train collision by sending an upper limit speed of the train or other alternative information (for example, a train stop position) from the on-ground communication means to the on-train communication means 101 and 102 up to the train through the control LAN 108 and the sending-and-receiving unit 109.

The grasping of train position is performed for each block section 107, in which only one train is allowed to be present, by judging whether or not a train is present there. The present embodiment is described on the premise that one station exists in one block section. However, in a case where distance between stations is long, plural block sections may be provided. In such a case, a block section without platform between stations is also provided with the on-ground means 103 and 104. In train control for safety, in a case where a train driver may be entrusted with train control in an infrequent section, information for automatically stopping the train such as an upper limit speed is not sent as information sent to the train, but a permission signal for permitting the train to move the next neighboring block section, for example, it can be considered that permission signal such as entering into a station, departure permission signal from a station may be sent.

In other words, in the present invention, when the speed of the train received through the sending-and-receiving part is larger than a predetermined value, the on-ground train control part outputs a permission signal for permitting the train to move to a next neighboring block section, and judges that the block section in which the communication has been performed is in a state of absence of train. The on-ground train control part controls the block section and the control of the presence/absence of train using a table of presence/absence of train on block section described in FIG. 4. The details are to be described later.

Further, an alternative is that when the speed of the train received through the sending-and-receiving part is larger than a predetermined value, and a preset time has elapsed after the on-ground communication device receives the speed of the train, the on-ground train control part outputs a permission signal for permitting the train to move to a next neighboring block section, and judges that the block section in which the communication has been performed is in a state of absence of train. Therein, the preset time means a time period from the time when the on-ground communication device receives the speed of the train until the train has passed through a boundary of the next neighboring block section.

As described above, according to the present invention, movement of a train between block sections can be promptly detected by providing a narrow wireless communication means in one side of a boundary of the block section. Therefore, there is an effect that the introduction cost of the communication means can be reduced to a one-half as low as that in conventional method in which communication means are provided in both of the entrance side and the exit side of a block section boundary.

Figure 2:
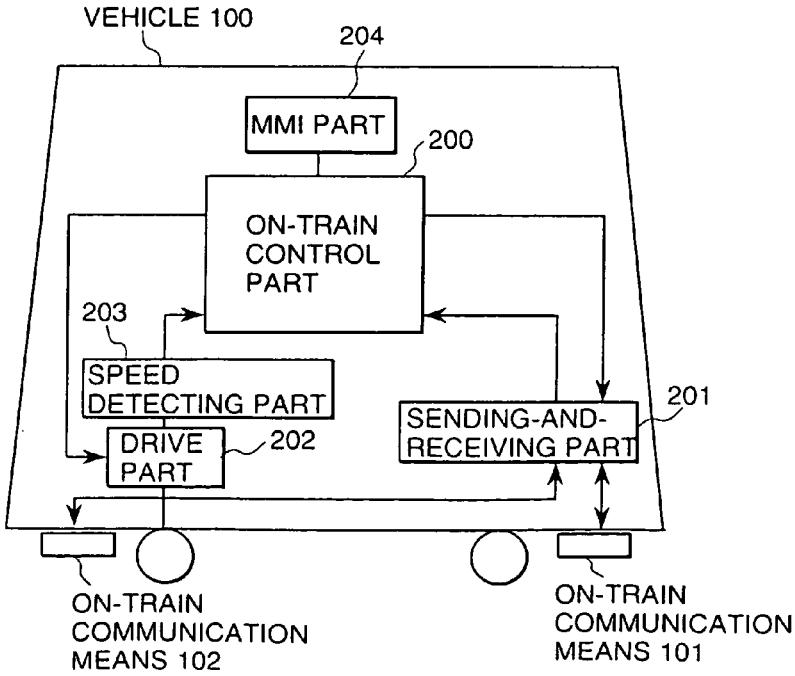
FIG. 2 is a block diagram showing the functional configuration of an example of the signal safety system inside a train in accordance with the present invention.

FIG. 2 shows a functional block diagram of a signal safety system possessed by the train 100.

The signal safety function in the train 100 is composed of an on-train control part 200; a sending-and-receiving part 201; a drive part 202; a speed detecting part 203; and an MMI (man machine interface) part 204. For detection of train position by the on-ground train control part 106, the on-train control part 200 sends in real time the train ID of identification number possessed by the train 100 and a ceaselessly varying train speed detected by the speed detecting part 203 to the ground side through the sending-and-receiving part 201 using the on-train communication means 101 and 102.

Further, the on-ground train control part 106 calculates an upper limit speed (a value, or a speed-to-distance pattern) to be kept by the train in order to avoid an accident such as collision, derail of the train from the grasped train position, and sends the calculated upper limit speed to the train side. The sent upper limit speed is received by the sending-and-receiving part 201 through the on-train communication means 101 and/or 102, and then transmitted to the on-train control part 200. The above-described communication between the ground side and the train side is not performed until the on-ground communication means 103,104 and the on-train communication means 101, 102 come within a communicable range (about 10 cm).

Figures 3, 4:
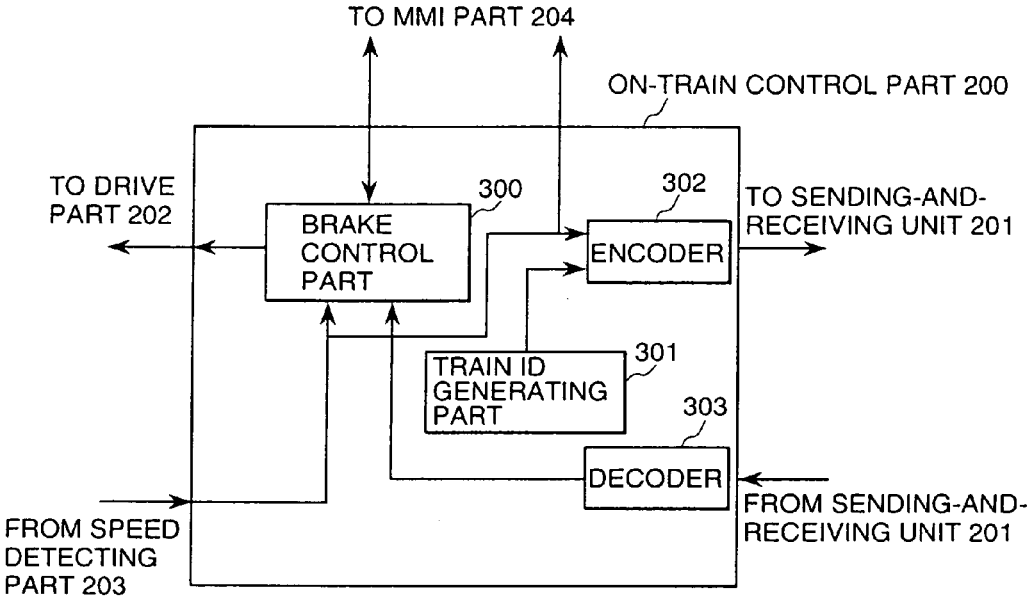
FIG. 3 is a block diagram showing an example of a configuration of an on-train control part in accordance with the present invention.
FIG. 4 is a view showing an example of a configuration of a table of presence/absence of train on block section in an on-ground train control part in accordance with the present invention.

FIG. 3 is a block diagram showing the configuration of the on-train control part 200. The on-train control part 200 is composed of a brake control part 300; a train ID generating part 301; an encoder 302; and a decoder 303. The train ID generating part 301 generates a specific train ID possessed by the train 100, and sends to the sending-and-receiving part 201 after converting it to a communication protocol by the encoder 302. The speed of the train 100 detected by the speed detecting part 203 is similarly converted to the communication protocol by the encoder 302, and then sent to the sending-and-receiving part 201. The data such as the upper limit speed transmitted by the sending-and-receiving part 201 is converted from the communication protocol to calculation data by the decoder 303 to be sent to the brake control part 300. The brake control part 300 compares the train speed transmitted from the speed detecting part 203 with the sent upper limit speed. If the train speed exceeds the upper limit speed, the brake control part 300 sends a brake command for reducing the train speed to the drive part 202 so as to make the train speed below the upper limit speed. The drive part 202 executes processing of reducing speed corresponding to the brake command sent from the speed detecting part 203. Further, the train speed transmitted from the speed detecting part 203 and the upper limit information sent from the sending-and-receiving part 201 are output to the MMI part 204 to be used for operation of the train by the train driver. That is, the train driver generates a speed command so that the train speed displayed on the MMI part 204 touches to the upper limit speed, and sends it to the brake control part 300. In the case where all the train control is left to the train driver in an infrequent railway section, as described above, entering into a station area, departure, the permission signal for entering a block section sent from the sending-and-receiving part 201 are directly displayed on the MMI part 204.

FIG. 4 shows a table of presence/absence of train on block section 400 possessed by the on-ground train control part 106.

The on-ground train control part 106 grasps and controls a present position of train by receiving the train ID from the train 100 through the on-ground communication means 103 and 104. The table of presence/absence of train on block section 400 is for this purpose. Number of columns prepared is equal to number of block sections, and symbols "1" and "0" are allocated depending on whether or not a train is present on the individual block sections. The table shows that trains are present on the block sections No. 1 and No. 4.

Figure 5:
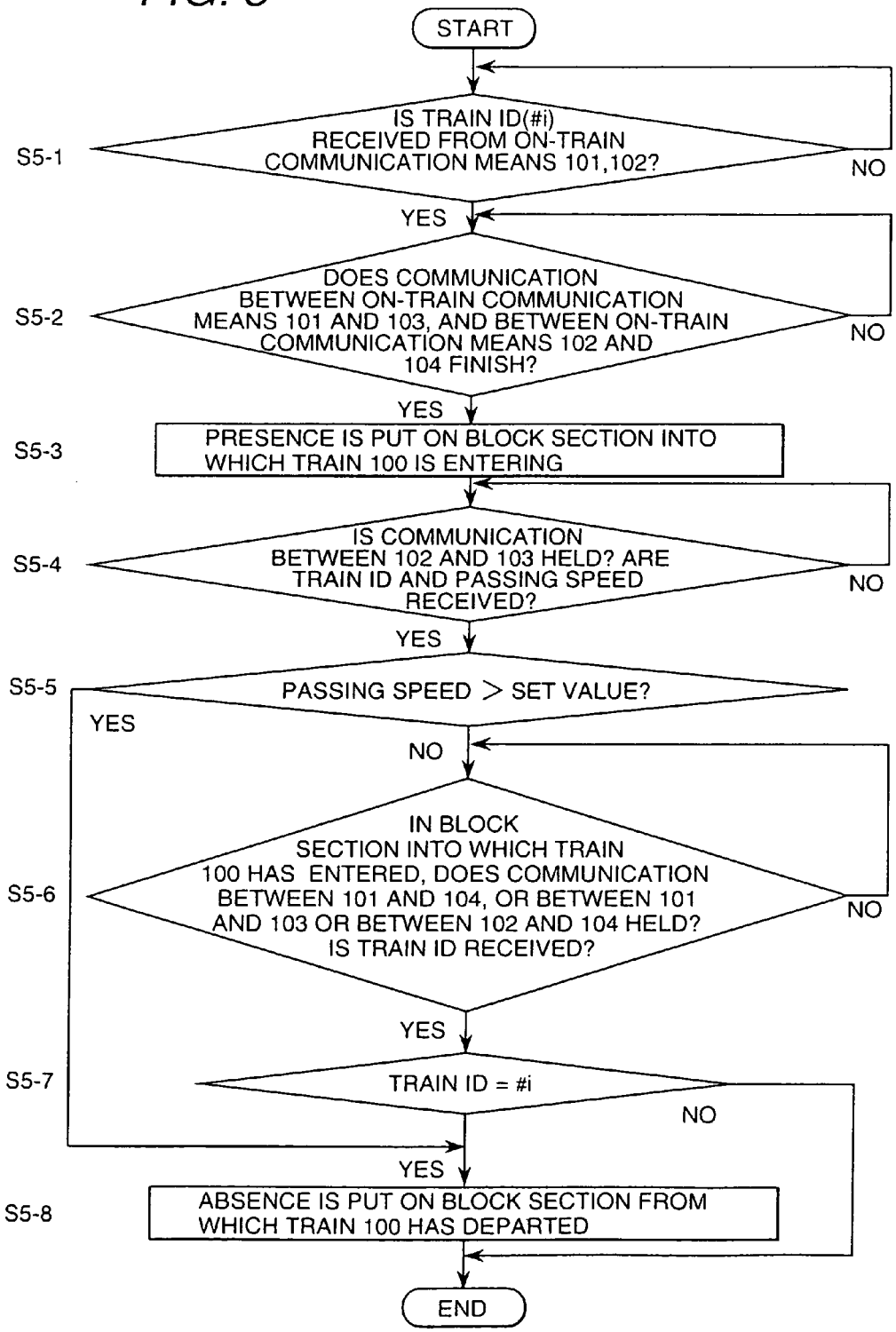
FIG. 5 is a flowchart showing the processing flow of train presence position judgment in the on-ground control part in accordance with the present invention.
Figure 7:
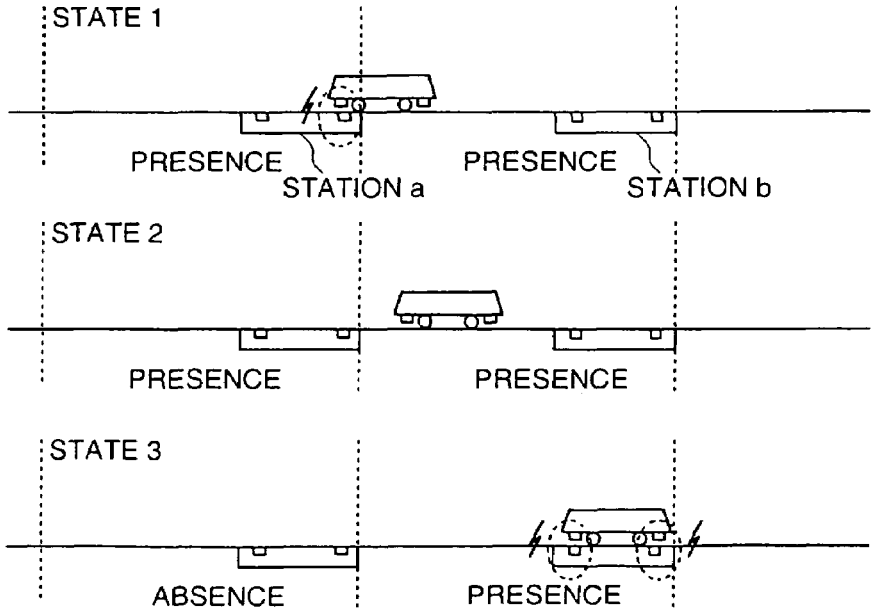
FIG. 7 is a schematic diagram showing a concept of the presence position judgment processing in accordance with the present invention.

Next, description will be made in detail on the procedure of grasping presence/absence of train on block section, referring to the processing flow of FIG. 5. In addition, FOG. 6 and FIG. 7 are schematic diagrams showing movement of a train on the ground at that time. The description will be made, referring to these figures.

Figure 6:
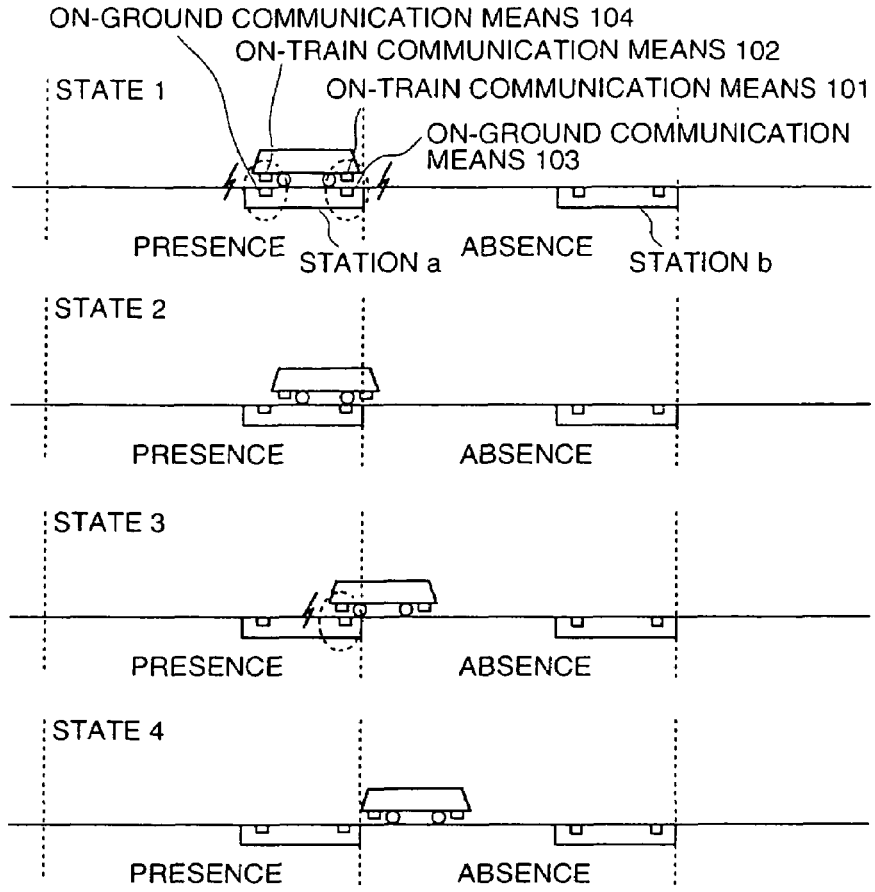
FIG. 6 is a schematic diagram showing a concept of the presence position judgment processing in accordance with the present invention.

In Process S5-1, it is judged whether or not the on-train communication means 101 and/or the on-train communication means 102 receive a train ID (here, #i). If not, the Process S5-1 is repeated because this means that the train does not arrive at the platform. When the train arrives at the platform, communication is initially performed between the on-train communication means 101 and the on-ground communication means 104. Then, at the time point when the train completely arrives at a predetermined position of the platform, the on-ground train control part 106 receives the train ID (#i) by performing communication between the on-train communication means 101 and the on-ground communication means 103 and between the on-train communication means 102 and the on-ground communication means 102 and the on-ground communication means 104. The state at this time point is shown by State 1 of FIG. 6.

The figure shows the state that the train arrives at the station a after moving on the block section corresponding to the station a. The block section of the station a is in the state of presence of train, and the block section of the station b is in the state of absence of train. After receiving the train ID (#i), the processing proceeds to Process S5-2 to judge whether or not the communication between the on-train communication means 101 and the on-ground communication means 103 and between the communication means 102 and the on-ground communication means 104 finishes. If the communication finishes, the processing proceeds to Process S5-3 to set the state of presence of train to the block section into which the train 100 enters. The state at this time point is shown by State 2 of FIG. 6, and departure of the train 100 from the station a shows that the communication between the on-train communication means 101 and the on-ground communication means 103 and between the communication means 102 and the on-ground communication means 104 has finished.

Since the train departs to enter into the block section of the station b, the presence of train is put to the block section into which the train enters, that is, the block section of the station b. If the communication does not finish yet, that means, the train is still stopping at the platform of the station b, the processing is returned to the Process S5-2. In Process S5-4, it is judged whether or not the communication between the on-train communication means 102 and the on-ground communication means 103 is performed, and the train ID (#i) and a speed of the train (a passing speed at performing the communication between the on-train communication means 102 and the on-ground communication means 103) are received. If the communication is performed, and the train ID (#i) and the passing speed are received, the processing proceeds to Process S5-5. The state at this time point is shown by State 3 of FIG. 6, and the on-train communication means 102 is passing above the on-ground communication means 104. Thereby, communication between the on-train communication means 102 and the on-ground communication means 104 is performed, and the train ID (#i) and a speed of the train at this moment are sent to the on-ground train control part 106. The speed of the train 100 sent hear is a speed of the train observed in real time by the speed detecting part 203, and a speed when the on-train communication means 102 is passing above the on-ground communication means 104.

If the communication is performed, but the train ID (#i) and the passing speed are not received, the processing is returned to Process S5-4 because it means that the train does not become State 3 yet. In Process S5-5, it is judged whether or not the received speed exceeds the preset set value. The set value at that time is a speed fast enough to pass through the boundary to the neighboring block section (in the figure, the block section of the station b) even if an abnormal situation such as stopping by hard braking, derailing, or blowout of a tire (in a monorail, city traffic etc) occurs after the on-train communication means 102 has passed above the on-ground communication means 104.

If the passing speed exceeds the set value, the processing proceeds to Process S5-8 to set the absence of train to the block section from which the train 100 departs. The preset time here is the set value (speed) used in the comparison with the passing time in Process S5-5, and is a time period from the time when the train passes through the on-ground communication means 104 to the time when the train passed through the boundary of the block section into which the train enters. The state at this time point is shown by State 4 of FIG. 6. The train 100 completely goes out from the block section of the station a, and is moving in the block section of the station b. Therefore, it is recognized that the block section of the station a is in the state of absence of train, and the block section of the station b is in the presence of train. Therein, the block section of the station b is set to the state of absence of train in the Process S5-8 by taking it into account that the passing speed exceeds the set value. However, in order to strictly reproduce the state of the train, it may be also considered that the processing of the Process S5-8 is executed at the time when a preset time elapses after processing the Process S5-5, that is, at the time after the train would pass through the boundary of the block section from the on-ground communication means 104 on the premise that the train moves at the set value (speed) used for the comparison with the passing speed in Process S5-5. If the passing speed does not exceed the set value in Process S5-5, the processing proceeds to Process S5-6. In Process S5-6, it is judged whether or not communication is performed between the communication means 101 and 104, between the communication means 101 and 103 or between the communication means 102 and 104, and the train ID is received, the processing proceeds to Process S5-7. If the communication is not performed, the processing is returned to Process S5-6. In Process S5-6, a substitutive method for detecting entering of the train 100 into the neighboring block section is executed when the passing speed does not exceeds the preset value.

FIG. 7 is a diagram showing a concept of the processing in the above case. The train 100 performs communication between the communication means 102 and 103 when passing through the station a, but the block section of the station a is still kept in the state of presence of train because the passing speed can not exceed the preset value though the train enters into the block section of the station b, as shown in State 2 of FIG. 7. In order to detect entering of the train into the block section of the station b, judgment of absence of train in the block section of the station a is executed by waiting for the train 100 to arrive at the station b. Therein, in order to check arriving of the train 100 at the station b, it is judged whether or not the train ID received at the station b agrees with the train ID received at the station a. In Process S5-7, it is judged whether or not the train ID received in a block section, which the train 100 enters into, agrees with the train ID (#i). If agrees, the processing proceeds to Process S5-8. If does not agree, the block section of the station a is kept in the state of presence of train by assuming that the train 100 entering into the block section of the station a does not arrive at the block section of the station b, and that another train arrives at the block section of the station b. In Process S5-8, the state of absence of train is put to the block section from which the train 100 has departed.

Therein, if the train ID received by the on-ground communication means through communication between the on-train communication means and the on-ground communication means in a certain block section and the train ID received by the on-ground communication means through communication between the on-train communication means and the on-ground communication means in the next block section neighboring to the certain block section agree with each other, the on-ground train control part 106 judges that the certain block section is in the state of absence of train.

According to the present invention, it is possible to propose a method of promptly judging movement of a train between block sections with a minimum number of transponders.

What is claimed is:

1. A signal safety apparatus for grasping a position of presence of train on the ground and on a train, which comprises:

an on-ground train control part for controlling operation of a train;

an on-ground communication device capable of performing communication of information by coming within a specified range; and a sending-and-receiving part capable of sending the information received by said on-ground communication device to said on-ground train control part and receiving the information sent from said on-ground train control part, wherein when an on-train communication device attached to a train comes within the specified range, said on-ground communication device receives a speed of said train from said on-train device, wherein said on-ground communication device is placed on a boundary of a block section in which only one train is allowed to be present, and in the communication between said on-ground communication device and said on-train communication device, said on-ground communication device receives a speed of said train and pre-registered identification information of said train from said on-train communication device, and wherein when the speed of said train received through said sending-and-receiving part is larger than a predetermined value, said on-ground train control part outputs a permission signal for permitting said train to move to a next neighboring block section, and judges that said block section in which the communication has been performed is in a state of absence of train.

2. A signal safety apparatus for grasping a position of presence of train on the ground and on a train, which comprises:

an on-ground train control part for controlling operation of a train;

an on-ground communication device capable of performing communication of information by coming within a specified range; and a sending-and-receiving part capable of sending the information received by said on-ground communication device to said on-ground train control part and receiving the information sent from said on-ground train control part, wherein when an on-train communication device attached to a train comes within the specified range, said on-ground communication device receives a speed of said train from said on-train device, wherein said on-ground communication device is placed on a boundary of a block section in which only one train is allowed to be present, and in the communication between said on-ground communication device and said on-train communication device, said on-ground communication device receives a speed of said train and pre-registered identification information of said train from said on-train communication device, and wherein when the speed of said train received through said sending-and-receiving part is larger than a predetermined value, and a preset time has elapsed after said on-ground communication device receives the speed of said train, said on-ground train control part outputs a permission signal for permitting said train to move to a next neighboring block section, and judges that said block section in which the communication has been performed is in a state of absence of train.

3. A signal safety apparatus according to claim 2, wherein said preset time means a time period from the time when said on-ground communication device receives the speed of said train until the train has passed through a boundary of the next neighboring block section.

4. A signal safety apparatus according to claim 2, wherein said on-ground communication device sends said on-train communication device said permission signal for permitting said train to move, said permission signal being received by said sending-and-receiving part from said on-ground control part.

5. A signal safety apparatus according to claim 2, wherein said on-ground communication device sends upper limit speed information or information for producing said upper limit speed information from said on-ground control part to said on-train communication device through said sending-and-receiving part.

6. A signal safety apparatus according to claim 2, wherein when identification information of a train received by said on-ground communication device through a communication between said on-train communication device and said on-ground communication device in a block section agrees with identification information of a train received by said on-ground communication device through a communication between said on-train communication device and said on-ground communication device in the next block section neighboring to said block section, said on-ground train control part judges that said block section is in a state of absence of train.

7. A signal safety method for grasping a position of presence of train on the ground and on a train, wherein when a train passes above an on-ground communication device which is placed on the ground and is capable of performing communication of information by coming within a specified range, said on-ground communication device receives information on a speed of said train and pre-registered identification information of said train from an on-train communication device provided in said train, and wherein when the received speed of said train is larger than a predetermined value, and a preset time has elapsed after said on-ground communication device receives the speed of said train, said on-ground communication device outputs a permission signal for permitting said train to move to a next neighboring block section to said on-train communication device.

8. A signal safety system for grasping a position of presence of train on the ground and on a train, which comprises:

an on-ground train control part for controlling operation of a train;

an on-ground communication device capable of performing communication of information by coming within a specified range, said on-ground communication device being placed on a boundary of a block section in which only one train is allowed to be present;

a sending-and-receiving part capable of performing communication with said on-ground train control part through a network, said sending-and-receiving part being capable of sending information received by said on-ground communication device to said on-ground train control part and receiving information sent from said on-ground train control part; and an on-train communication device capable of performing communication with said on-ground communication device, said on-train communication device being attached to said train, wherein when said on-train communication device comes near said on-ground communication device, said on-ground communication device receives a speed of said train and pre-registered identification information of said train from said on-train communication device and sends the speed of said train and the identification information of said train to said sending-and-receiving part, said on-ground train control part outputting a permission signal for permitting said train to move to a next neighboring block section based on the speed of said train and the identification information of said train received from said sending-and-receiving p art through the network, said on-ground communication device sending the permission signal received from said on-ground train control part to said on-train communication device.

9. A signal safety system according to claim 8, which further comprises a speed detecting part for detecting a speed by sensing rotation speed of a wheel shaft, said speed detecting part being arranged in said train.

* * * * *